US005701623A

United States Patent [19]

May

[11] Patent Number: 5,701,623

[45] Date of Patent: Dec. 30, 1997

[54] COMPOSITE MATTRESS AND MATTRESS TOPPER HAVING A LATEX FOAM CORE

[75] Inventor: Jonathan J. May, Guilford, Conn.

[73] Assignee: Latex Foam Products, Inc., Ansonia, Conn.

[21] Appl. No.: 664,767

[22] Filed: Jun. 17, 1996

Related U.S. Application Data

[63] Continuation-in-part of Ser. No. 613,970, Mar. 11, 1996, abandoned.

[51] Int. Cl.[6] ..... A47C 27/15

[52] U.S. Cl. ..... 5/739; 5/740; 5/903

[58] Field of Search ..... 5/727, 739, 740, 5/903

[56] References Cited

U.S. PATENT DOCUMENTS

| | | | |
|---|---|---|---|
| 2,469,084 | 5/1949 | Schenker . | |
| 2,612,158 | 9/1952 | Manley . | |
| 3,110,042 | 11/1963 | Slemmons . | |
| 3,118,153 | 1/1964 | Hood . | |
| 3,210,781 | 10/1965 | Pollock | 5/727 X |
| 3,278,955 | 10/1966 | Fredlander et al. | 15/739 X |
| 3,521,311 | 7/1970 | Cohen | 5/740 X |
| 3,553,749 | 1/1971 | Majeske . | |
| 3,644,950 | 2/1972 | Lindsay, Jr. . | |
| 3,885,258 | 5/1975 | Regan . | |
| 3,939,508 | 2/1976 | Hall et al. . | |
| 4,042,987 | 8/1977 | Rogers . | |
| 4,053,957 | 10/1977 | Regan . | |
| 4,086,675 | 5/1978 | Talbert et al. | 5/740 X |
| 4,336,621 | 6/1982 | Schwartz et al. | 5/403 X |
| 4,975,996 | 12/1990 | Evans et al. . | |

*Primary Examiner*—Michael F. Trettel

[57] ABSTRACT

A mattress having a core section of latex foam rubber at least partially surrounded by border sections of synthetic urethane foam having substantially the same thickness as the core section. The synthetic border sections are adhesively attached to the periphery of the core section. The mattress can be used as a mattress topper as well as a full mattress.

7 Claims, 2 Drawing Sheets

COMPOSITE MATTRESS AND MATTRESS TOPPER HAVING A LATEX FOAM CORE

This is a Continuation-in-Part of pending application Ser. No. 087/613,970 filed Mar. 11, 1996 which is now abandoned.

FIELD OF THE INVENTION

This invention relates to the field of mattresses and, in particular, to composite foam mattresses and mattress toppers utilized for bedding.

BACKGROUND OF THE INVENTION

The quality of a mattress design is generally quantified by their comfort and durability. Since these characteristics are somewhat subjective, standardized tests have been developed and published for these characteristics (and other related descriptions and definitions) by the American Society for Testing and Materials (as ASTM D 3574-86 and ASTM D 1055-85.) These ASTM tests and standards are used throughout this disclosure and are herein incorporated by reference. Another consideration that is always present in the design of mattresses is cost. Thus, in designing mattress, among the factors that are considered are the comfort, the durability and the cost.

Both comfort and durability are affected by the materials used in the production of mattresses. In an effort to increase comfort and durability, some mattress designs incorporate several laminates or layers of different materials and/or support structure, such as springs, into the mattress. An example of such a design is disclosed in U.S. Pat. No. 3,521,311 to Cohen. These types of designs can be effective but are expensive to manufacture.

Other materials and manufacturing techniques are also employed to improve the comfort and durability of mattresses. For example, U.S. Pat. No. 3,320,339 to Smith discloses a mattress formed of a core of relatively low-density latex material surrounded by an integrally-molded border of higher-density latex. To manufacture this mattress, the two materials are poured into two areas of a mold (a center area and the surrounding border) which are separated by a barrier strip. During the vulcanization process, the barrier strip dissolves, and the core and border fuse together. This is an effective design however with this method, the core and border must be formed simultaneously, which may not always be desirable when, for example, the different sections would be optimally vulcanized at different temperatures and/or for different lengths of time. Also, because the mattress is composed entirely of latex foam rubber, it is relatively expensive.

Generally, the use of latex foam rubber in mattresses is desirable because latex is durable and provides a high level of comfort and support. More specifically, latex foam rubber is known to remain resilient even though it is used repetitively over a long span of time. A latex foam mattress can last 20 or more years without substantial decline in its resilience. Some mattress designs, such as that described above, use latex foam rubber throughout the mattress. These designs are comfortable and durable, however, they are expensive. Moreover, much of the benefit from the latex foam material is not realized and is therefore wasted, especially along the border of the mattress where it is not subject to repetitive and heavy use.

What is desired therefore, is a mattress design which is relatively easy and inexpensive to manufacture, and which includes both core and border sections which need not be formed simultaneously and which need not be comprised of the same material.

SUMMARY OF THE INVENTION

Accordingly, it is an object of the invention to provide a mattress with a core of latex foam rubber and border sections of synthetic urethane foam or other inexpensive foams.

It is another object of the invention to provide a mattress of the above character with core and border sections which are sized to minimize the use of the relatively expensive latex foam rubber while maintaining a high level of comfort and durability.

It is a yet another object of the invention to provide a mattress of the above character with the a border formed of a plurality of sections adhered to the periphery of the core section.

It is still another object of the invention to provide a mattress of the above character with the volume of the border comprising at least about 15 percent of the total mattress volume and preferably at least about 30 percent of the total mattress volume.

It is a further object of the invention to provide a mattress of the above character with the latex core having a density of between 2 and 6 lbs. per cubic foot.

It is another object of the invention to provide a mattress of the above character with the border having a density of between 1 and 4 lbs. per cubic foot.

It is the object of the invention to provide a thin composite mattress of the type used as a topper for a conventional mattress. More specifically, it is an object of the invention to provide a thin mattress on the order of one-quarter to four inches thick, that has the area of a conventional mattress. This topper mattress is placed over a conventional mattress and is used to provide the comfort of latex foam without the expensive of replacing the conventional mattress.

These and other objects of invention are realized by a mattress having a core section of latex foam rubber at least partially surrounded by sections of synthetic urethane foam adhesively attached to the periphery of the core section. The border sections are substantially the same thickness as the core section but may be of a different density. The core section preferably has a density of between 2 and 6 lbs. per cubic foot. The border sections preferably have densities of between 1 and 4 lbs. per cubic foot.

In accordance with one aspect of the invention, a mattress topper is provided and as a core section of latex foam rubber at least partially surrounded by sections of synthetic urethane foam attached by adhesive to the periphery of the core section. The latex topper is for use on top of an existing conventional mattress, to increase the comfort of the mattress while utilizing an existing conventional mattress. The topper can be used as an after market product and placed on top of a mattress. Alternatively, the topper can be placed on an unfinished mattress (either a conventional mattress including steel springs or a foam mattress) and the topper and the mattress is then covered with fabric.

These and other preferred aspects of the invention are described in more detail below and will be better appreciated from the detailed description, especially when read in light of the following drawings.

DETAILED DESCRIPTION OF THE INVENTION

Figure 1:
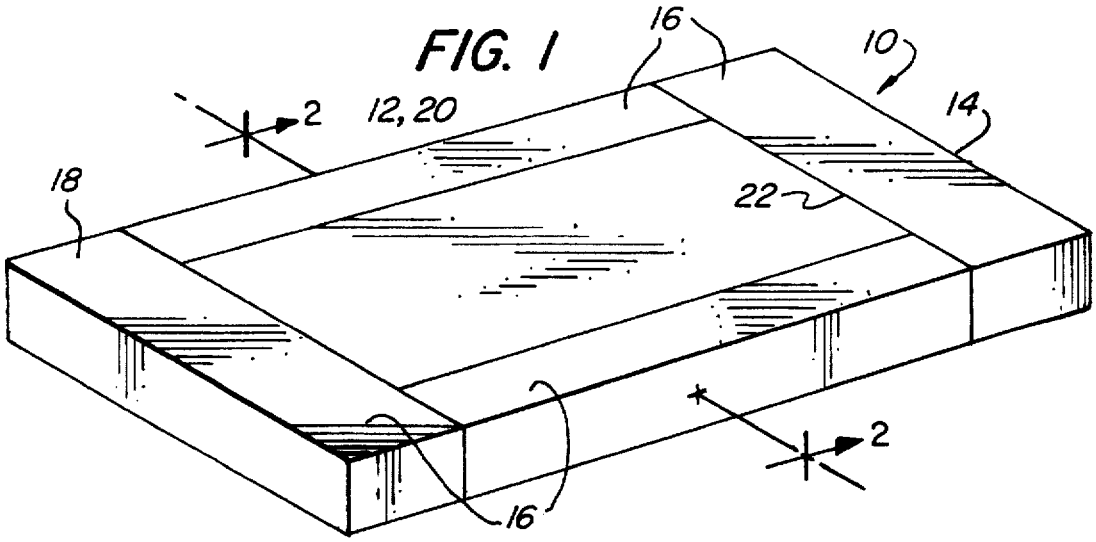
FIG. 1 is an isometric view of the mattress of the present invention.

Referring to FIG. 1, in one embodiment, the mattress 10 of the present invention includes a core section 12 and a frame section 14. Frame 14 is formed of a number of border sections 16. Preferably, all of the sections have substantially the same thickness (or height) so that the top surface 18 of mattress 10 is substantially planar. Core section 12 is located in the area of heaviest use of mattress 10 and the area of greatest importance (i.e. the center portion 20, which supports the back and waist of a sleeper.) The area outside the outer periphery 22 of core section 12 is not used with the same intensity as is center portion 20 (i.e. sleepers do not generally sleep with their back and waist on the mattress edge), therefore the high durability and comfort characteristics of latex foam rubber are not required in border sections 16.

Figure 2:
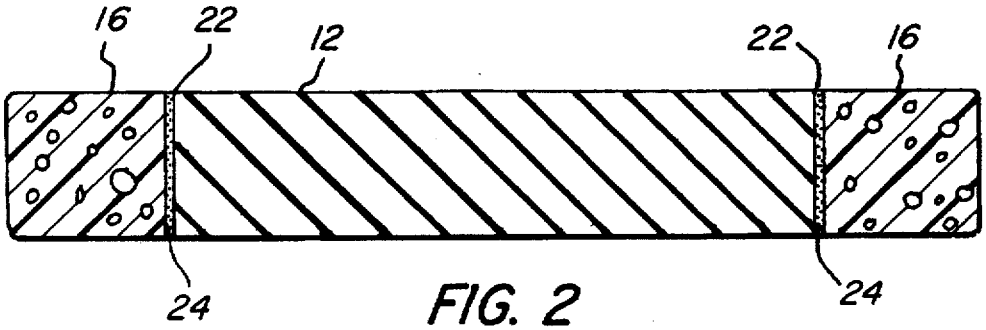
FIG. 2 is a cross-sectional view along line 2—2 of FIG. 1 of the mattress of the present invention.
Figure 3:
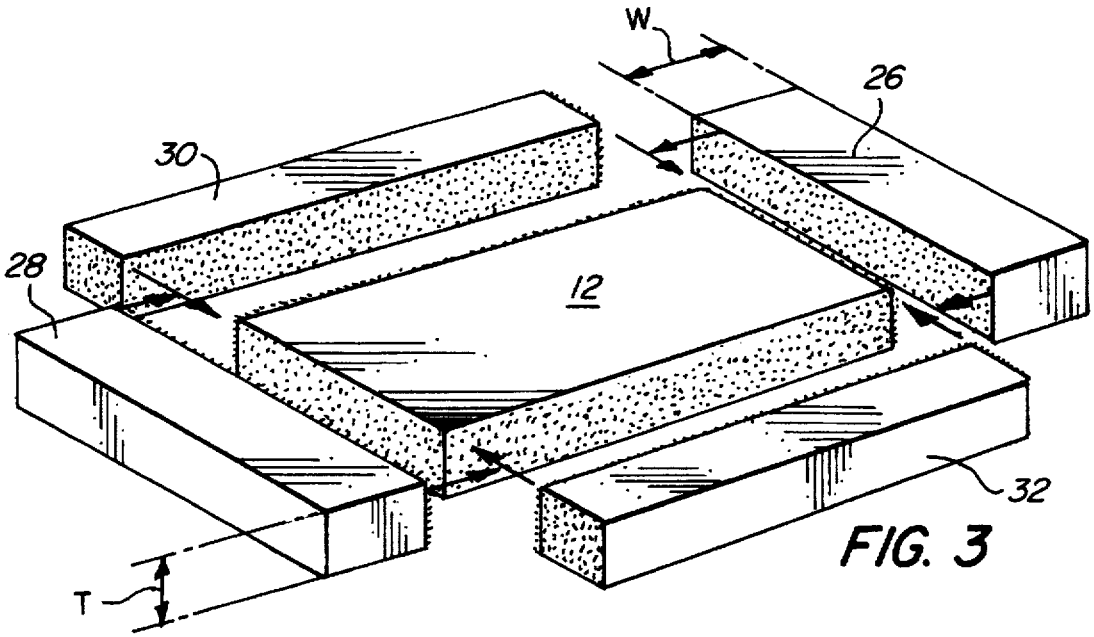
FIG. 3 is an exploded, isometric view of the mattress of FIG. 1 prior to assembly.

Referring to FIGS. 2 and 3, border sections 16 are located around periphery 22 of core section 12 and may be attached to periphery 22 by an adhesive 24, or by any other suitable method. Preferably, border sections 16 are rectangular in shape with the head and foot sections 26, 28 extending laterally beyond the core to cover the ends of the side sections 30, 32 so as to form a rectangular mattress. Alternatively, the ends of border sections 16 could be angled at 45 degrees (similar to the design of a standard picture frame) to form such a rectangle.

The core section 12 can be made of a single layer of latex foam rubber. However, the core section 12 could also be made of multiple layers of latex foam rubber of different densities or two blocks of latex foam rubber placed side by side to provide two firmness levels in a mattress intended for use by a couple.

Further, it is most preferred that the core section consist essentially of 100 percent foam rubber, but it is acceptable that the core section include small amounts of urethane or other similar synthetic foams.

It should be appreciated, however, that in other embodiments, four border sections are not required and other border configurations may be used within the contemplation of the invention. In this case, the core section 12 would be only partially surrounded by the border sections 16. For example, mattress 10 could include a core section 12 with only two border sections 16, for example only side sections 30, 32 or only head and foot sections 26, 28 or any combination thereof.

Preferably core and border sections 12, 16 are approximately 3 to 11 inches thick (H, as shown in the figures). Preferably the head and foot sections 26, 28 are between about 7 and 10 inches in width (W, i.e. horizontal width, as shown in the figures) and preferably side sections 30, 32 are approximately between about 4 and 6 inches in width. Also, the volume of border sections 16 is at least about 15 percent of the total volume of the mattress and preferably at least about 30 percent of the total volume.

Figure 4:
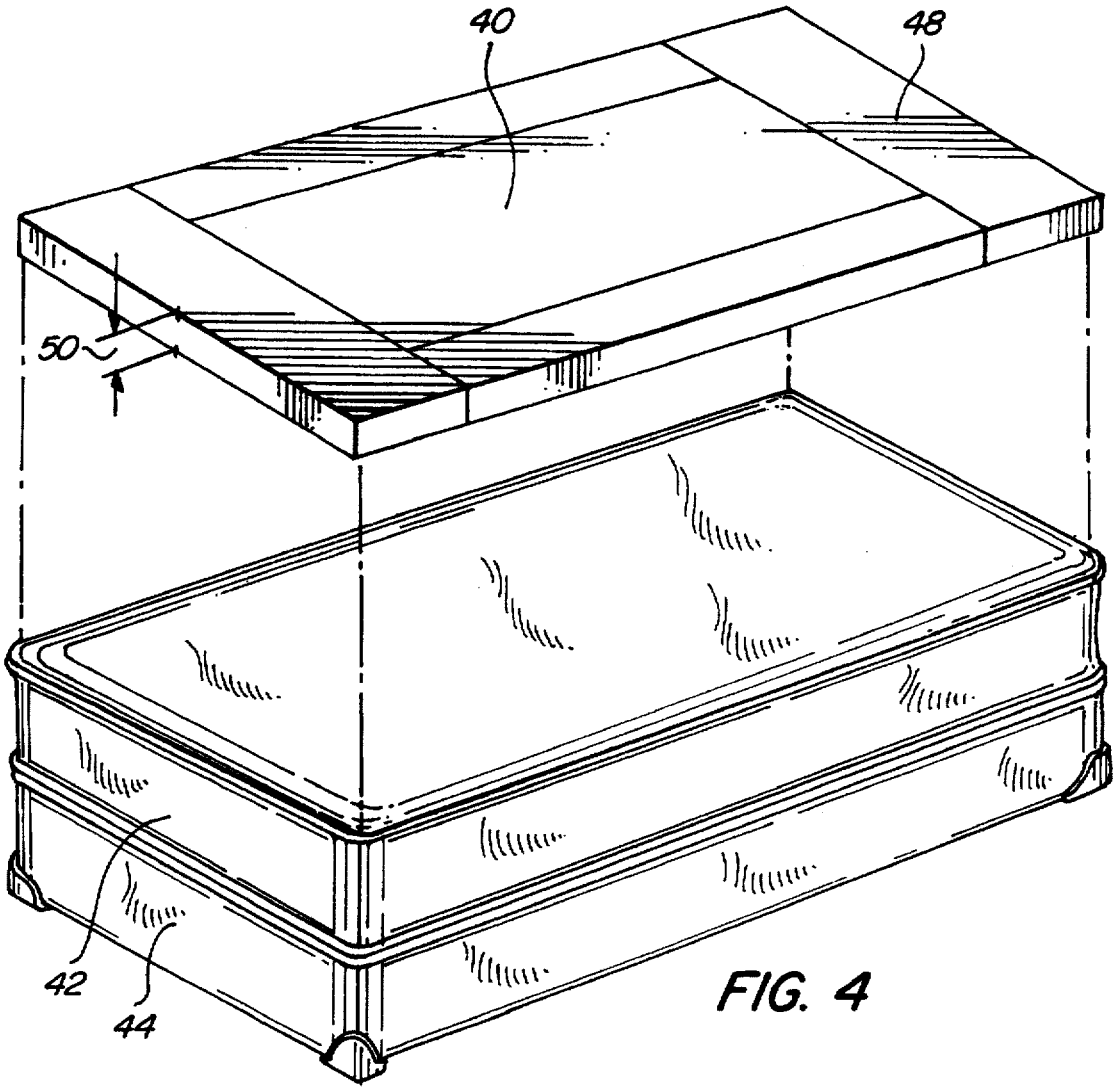
FIG. 4 is an isometric view of a mattress topper being placed upon a conventional mattress and box spring.

Referring to FIG. 4, another embodiment of the invention is shown. The mattress 40 is a topper for a conventional mattress 42 which rests upon a conventional box spring 44. The mattress 40 includes a core section 46 and a frame section 48. The frame and core sections have the same materials and densities as described with respect to the mattress shown and described in FIGS. 1–3. Preferably, the frame section 14 is made from four sections and is adhered around the periphery. However, as in the case of the mattress described in FIGS. 1–3, the frame section has at least two border sections.

The mattress 40, which is used as a topper, is made in a similar fashion to the mattress described in FIGS. 1–3. However, it is possible to manufacture a block of a relatively large thickness and then slice the block to form a plurality of mattress toppers, such as mattress topper 40. Mattress topper 40 has a thickness 50 that is between about one-quarter inch and about four inches, and most preferably between about an inch and about three inches.

Figure 5:
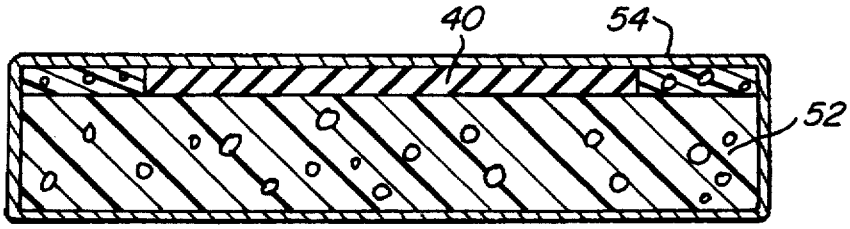
FIG. 5 is a sectional view of a mattress topper and mattress assembled together and covered.

The topper 40 is laid on top of the top surface of conventional mattress 42 and is held in position by the friction between the mattress 40 and the top of conventional mattress 42. In addition, a mattress pad, typically made of quilted cotton material can be placed over the mattress topper 40, and the mattress cover typically has prefabricated corners that are thick enough to hold both mattress topper 40 and mattress 42 together as a unit. Alternatively, as shown in FIG. 5, the topper 40 is placed on a mattress 52 that can be either a conventional mattress with steel springs, a foam mattress (either latex foam, urethane foam or other polymeric foams) or another type of mattress. The topper 40 and the mattress 52 are held together by a fabric cover 54 that is sewn around the exterior of the mattress, as is the case with most conventional bedding mattresses.

With respect to the mattresses shown in FIGS. 1–5, the border sections are made from urethane foam, that is, the cellular product produced by the interaction of active hydrogen compounds, water and isocynates. The urethane foam may be a bonded foam, that is, a product produced by the adhesion of small pieces of urethane foam to each other with a suitable bonding agent and with or without fillers. The urethane foam may also be a molded foam, that is, a cellular foam product molded in an enclosed chamber or slab foam which is a section of foam cut from the internal portion of a large bun.

The core section is made from latex foam rubber, that is, foam wherein the material used in the manufacture is natural rubber latex, reclaimed rubber latex, synthetic rubber latex, or rubber-like materials used alone or in combination.

In accordance with one aspect of the invention, the latex core and the urethane border sections may have different levels of firmness. In a preferred form of the invention, the border sections are firmer than the core to provide firm support when a person sits on the edge of the mattress.

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention as defined in the appended claims.

What is claimed is:

1. A bedding such as a mattress or topper comprising:

a generally rectangular core having perimeter sides, a width, length, thickness and volume, said core consisting essentially of latex foam rubber having a density of between about 2 lbs. per cubic foot and about 6 lbs. per cubic foot;

a border formed of two border side sections having a thickness and a volume, said border side sections being affixed to head and foot perimeter sides of the core, said border side sections comprising urethane foam and having a density of between about 1 and about 4 lbs. per cubic foot, said thickness of said border side sections being approximately the thickness of said core; and the border volume comprising at least about 15 percent of the total volume of said core and said border.

2. A bedding mattress comprising:

a generally rectangular core section having perimeter sides, a width, length, thickness and volume, said core consisting essentially of latex foam rubber having a density of between about 2 lbs. per cubic foot and about 6 lbs. per cubic foot;

at least four border sections comprising a head, foot and two side sections and having a thickness and a volume, said border sections being affixed to said core perimeter sides, said border sections comprising urethane foam and having a density of between about 1 and about 4 lbs. per cubic foot, said thickness of said border sections being approximately the thickness of said core; and the border sections volume comprising at least about 30 percent of the total volume of said core and said border sections;

wherein said side sections further comprise ends and wherein said head and foot sections extend laterally beyond said core section to cover said ends of said side sections.

3. A bedding such as a mattress or topper comprising:

a generally rectangular core having perimeter sides, a width, length, thickness and volume, said core consisting essentially of latex foam rubber having a density of between about 2 pounds per cubic foot and about 6 pounds per cubic foot, said core thickness being between about one quarter inch and about 11 inches;

a border formed with four border sections having a thickness and a volume, said border sections being affixed to respective core perimeter sides with ends of said border sections being in overlapping relationship with each other, said border comprising urethane foam and having a density of between about 1 and about 4 pounds per cubic foot, said thickness of said border being approximately the thickness of said core; and the border volume comprising at least about 15% of the total volume of said core and said border.

4. A bedding such as a mattress or a topper comprising:

a rectangular core of latex foam rubber having a periphery and having a thickness of between about a quarter of an inch and about 11 inches;

a border of synthetic urethane foam attached to said periphery, said border having a thickness substantially equal to said thickness of said core; said border comprising a head, a foot and two side sections, said head, foot and side sections being attached to said core periphery; said head and foot sections having widths of between about 7 and 10 inches, said side sections having widths of between about 4 and 6 inches, and with ends of said foot and head sections being in overlapping attached relationship with ends of said side sections; and with said border volume comprising at least about 15 percent of the total volume of said border and core.

5. A bedding mattress as in claim 4 wherein said border volume comprises at least about 30 percent of the combined border and core volume.

6. A method of manufacturing a bedding such as a mattress or a topper comprising:

forming a rectangular core of latex foam rubber having a periphery and having a thickness, said core having a volume;

forming a border of synthetic urethane foam having a thickness substantially equal to said thickness of said core and having a head, said border including a foot and two side sections, said head and foot sections having widths of between 7 and 10 inches, said side sections having widths of between 4 and 6 inches, said border having a volume;

adhering said border to said periphery of said core with ends of said head and foot sections being in overlapping relationship with ends of said side sections; and with said border volume comprising at least 15 percent of the combined core and border volume.

7. A method according to claim 6 wherein said border volume comprises at least 30 percent of the combined core and border volume.

* * * * *